United States Patent [19]

Zbornik

[11] Patent Number: 4,966,029

[45] Date of Patent: Oct. 30, 1990

[54] METHOD OF BENDING A WORKPIECE TO A PREDETERMINED BENDING ANGLE

[75] Inventor: Vaclav Zbornik, Oftringen, Switzerland

[73] Assignee: Haemmerle AG, Switzerland

[21] Appl. No.: 339,074

[22] Filed: Apr. 14, 1989

[30] Foreign Application Priority Data

Apr. 25, 1988 [AT] Austria ..... 1046/88

[51] Int. Cl.[5] ..... B21C 37/02

[52] U.S. Cl. ..... 72/379.2; 72/389; 72/432; 72/446; 72/448

[58] Field of Search ..... 72/389, 448, 386, 431, 72/432, 465, 453.03, 702, 473, 379, 446

[56] References Cited

U.S. PATENT DOCUMENTS

| | | | |
|---|---|---|---|
| 3,552,182 | 1/1971 | Handler | 72/432 |
| 3,844,156 | 10/1974 | Hanni et al. | 72/473 |
| 3,978,706 | 9/1976 | Nakagawa et al. | 72/389 |
| 4,106,323 | 8/1978 | Haenni et al. | 72/448 |
| 4,131,008 | 12/1987 | Malatto | 72/389 |
| 4,653,307 | 3/1987 | Zbornik | 72/389 |
| 4,802,357 | 2/1989 | Jones | 72/702 |
| 4,864,509 | 9/1989 | Somerville et al. | 72/389 |

FOREIGN PATENT DOCUMENTS

| | | | |
|---|---|---|---|
| 0166351 | 1/1986 | European Pat. Off. | 72/702 |
| 0000417 | 1/1979 | Japan | 72/389 |
| 0202928 | 12/1982 | Japan | 72/389 |
| 0229421 | 10/1986 | Japan | 72/702 |

*Primary Examiner*—David Jones

*Attorney, Agent, or Firm*—Tarolli, Sundheim & Covell

[57] ABSTRACT

The invention provides a method of bending a workpiece to a predetermined bending angle, in which, in a first step, the workpiece is bent to a somewhat greater bending angle and then released. Thereafter, the amount of resilient back motion occurring after the first bending operation is measured. The adjustable die bottom is readjusted such that a bending angle would result in the next bending operation which corresponds to the desired final bending angle minus the amount of resilient back motion. After the second bending operation, the workpiece is released and the legs thereof will resiliently move back to enclose the final predetermined bending angle.

2 Claims, 2 Drawing Sheets

METHOD OF BENDING A WORKPIECE TO A PREDETERMINED BENDING ANGLE

BACKGROUND OF THE INVENTION

1. Field of the Invention

The present invention refers to a method of bending a workpiece to a predetermined bending angle by means of a bending apparatus which comprises a movable bending bar and a fixed bottom die having a die bottom member, the height position thereof being adjustable in accordance with the bending angle to be achieved.

Particularly, the present invention refers to a method of bending a workpiece to a predetermined bending angle by means of a bending apparatus which comprises a movable bending bar resiliently supported on a pressurerized fluid cushion and a fixed bottom die having a die bottom member, the height position thereof being adjustable in accordance with the bending angle to be achieved.

If a piece of sheet metal has to be bent by means of a bending bar and a cooperating bending die, it is quite difficult to precisely realize a predetermined bending angle. Although the bending angle can be theoretically calculated if the width of the upper aperture of the bottom die and the depth of penetration of the bending bar into the upper aperture is known; in practice, however, the calculated results cannot be achieved because the actual bending angle shows greater or smaller deviations from the nominal value due to inaccuracies of the bending bar movement as well as due to variations of quality and thickness of the sheet material to be bent.

2. Prior Art

A certain improvement is possible by the use of a bending apparatus in which the bending angle can be adjusted and changing easily and exactly. Preferably, such an apparatus comprises a bottom die having an upper longitudinal aperture directed towards the bending bar and a die bottom member which can be adusted in height position. The bending angle is exactly defined by the height position of the die bottom member, and by re-adusting said position different bending angles can be realized without the need of exchanging the bottom die.

The bottom die comprises a longitudinally running groove whose opening is directed towards the bending bar, and the bending angle is defined by the distance between the two fixed upper edges of the groove running parallel to each other and by the height position of the top surface of the movable die bottom member. However, also in this case, a resilient back movement of the two legs of the bent sheet metal workpiece can be observed as soon as the bending force is released from the workpiece with the result that the actual bending angle does not coincide with the theoretically calculated value of the bending angle.

Thus, it is imperative to run test bending operations with a specified quality and thickness of sheet metal in order to determine the deviation of the actual bending angle from the nominal value. As soon as the deviation is available, the path of movement of the bending bar towards the bottom die and/or the height position of the die bottom member can be corrected in accordance with the deivation factor before the production of the bent sheet metal workpieces finally starts.

OBJECTS OF THE INVENTION

It is an object of the invention to improve the methods known in the prior art and to provide a method of bending metal workpieces to a predetermined bending angle within very narrow tolerances.

It is a further object of the invention to provide a method of bending sheet metal workpieces to a predetermined bending angle within very narrow tolerances in which the need is removed to run test bending operations prior to production start.

It is a further object of the invention to provide a method of bending sheet metal workpieces to a predetermined bending angle within very narrow tolerances independently of their material quality and/or thickness.

SUMMARY OF THE INVENTION

According to a first aspect of the present invention, there is provided a method of bending a workpiece to a predetermined bending angle by means of a bending apparatus which comprises a movable bending bar and a fixed bottom die having a die bottom member. The height position of the die bottom member is adjustable in accordance with the bending angle to be achieved.

In a first step, the die bottom member is adjusted to a height position which corresponds to a first nominal bending angle greater than said predetermined bending angle and the workpiece to be bent is inserted between the movable bending bar and the fixed bottom die. Then, the bending bar is displaced towards the bottom die until the leading edge of the bent workpiece abuts against the top of the die bottom member, thereby continuously bending said workpiece to said first nominal bending angle.

In a second step, the bending force extending on the workpiece bent to said first nominal bending angle is released, thereby allowing the workpiece to resiliently move back into its slacked condition, and the actual bending angle of the workpiece when it is in its slacked position is measured, the value of this first actual bending angle is compared with the value of said first nominal bending angle and the difference is calculated.

In a third step, the die bottom member is re-adjusted to a height position corresponding to a second nominal bending angle having the value of said predetermined bending angle minus said calculated difference between said measured first actual bending angle and said first nominal angle.

In a fourth step, a bending force is exerted again on the workpiece to be bent until the leading edge of the workpiece abuts against the top of the die bottom member thereby further bending the workpiece to said second nominal bending angle, and finally, the bending force exterted on the workpiece bent to said second nominal bending angle is released, thereby allowing the workpiece to resiliently move back into its slacked condition in which it is bent to said predetermined bending angle.

According to a second aspect of the present invention, there is provided a method of bending a workpiece to a predetermined bending angle by means of a bending apparatus which comprises a movable bending bar resiliently supported on a pressurized fluid cushion and a fixed bottom die having a die bottom member. The height position of the die bottom member is adjustable in accordance with the bending angle to be achieved.

In a first step, the die bottom member is adjusted to a height position which corresponds to a first nominal bending angle grerater than said predetermined bending angle and the workpiece to be bent is inserted between the movable bending bar and the fixed bottom die. Then, the bending bar is displaced towards the bottom die until the leading edge of the bent workpiece abuts against the top of the die bottom member, thereby continuously bending said workpiece to said first nominal bending angle.

In a second step, the pressure is reduced in said fluid cushion on which the movable bending bar is supported, thereby allowing the workpiece to resiliently move back into its slacked condition, and the actual bending angle of the workpiece is measured when it is in its slacked position, the value of this first actual bending angle is compared with the value of said first nominal bending angle and the difference is calculated.

In a third step, the die bottom member is re-adjusted to a height position corresponding to a second nominal bending angle having the value of said predetermined bending angle minus said calculated difference between said measured first actual bending angle and said first nominal angle.

In a fourth step, a bending force is exerted again on the workpiece to be bent until the leading edge of the workpiece abuts against the top of the die bottom member thereby further bending the workpiece to said second nominal bending angle, and finally, the bending force exerted on the workpiece bent to said second nominal bending angle is released, thereby allowing the workpiece to resiliently move back into its slacked condition in which it is bent to said predetermined bending angle.

According to a third aspect of the invention, there is provided a method of bending a workpiece to a predetermined bending angle by means of a bending apparatus which comprises a movable bending bar resiliently supported on a pressurized fluid cushion and a fixed bottom die having a die bottom member. The height position of the die bottom member is adjustable in accordance with the bending angle to be achieved.

In a first step, the die bottom member is adjusted to a height position which corresponds to a first nominal bending angle greater than said predetermined bending angle and the workpiece to be bent is inserted between the movable bending bar and the fixed bottom die. Then, the bending bar is displaced towards the bottom die until the leading edge of the bent workpiece abuts against the top of the die bottom member, thereby continuously bending said workpiece to said first nominal bending angle.

In a second step, the pressure is reduced in said fluid cushion on which the movable bending bar is supported, thereby allowing the workpiece to resiliently move back into its slacked condition, and the actual bending angle of the workpiece is measured when it is in its slacked position, the value of this first actual bending angle is compared with the value of said first nominal bending angle and the difference is calculated.

In a third step, the die bottom member is re-adjusted to a height position corresponding to a second nominal bending angle having the value of said predetermined bending angle minus said calculated difference between said measured first actual bending angle and said first nominal angle.

In a fourth step, the pressure is increased in the fluid cushion on which the movable bending bar is supported until the leading angle of the workpiece abuts against the top of the die bottom member thereby further bending the workpiece to said second nominal bending angle, and finally, the bending force exerted on the workpiece bent to said second nominal bending angle is released, thereby allowing the workpiece to resiliently move back into its slacked condition in which it is bent to said predetermined bending angle.

For performing either of the three above mentioned method variants, a bending angle measuring means is required to continuously and precisely determine the bending angle during the bending operation. The inventor of the present invention has disclosed a suitable angle measuring apparatus in his copending patent application Ser. No. 317,965 having the title "A Sheet Metal Bending Apparatus". The angle measuring means can be used to continuously monitor the bending angle of a sheet metal piece during the bending operation and comprises a rest member contacting the sheet metal piece to be bent in a first portion thereof and a calliper member contacting the sheet metal piece to be bent in a second portion thereof. The second portion is distant from the first portion. The position of the tie line between the contact points of the rest member and the calliper member on the sheet metal piece corresponds to the instant angular position of the leg of the sheet metal piece. An angle measuring device is provided to measure the pivotal motion of the calliper member. The angle measuring device is connected to the movable calliper member by means of a paralelogram articulation assembly.

By means of such an angle measuring device, the actual bending angle can be determined continuously and exactly; a deviation of the actual bending angle from the nominal bending angle can be exactly measured.

A further provision contributing to an improved accuracy of the bending operation consists in preventing or compensating a deformation of the elements of the bending apparatus which are primarily involved in the bending operation. For this purpose, it is known in the prior art to use a bending bar connected to a bending bar holder which rests on a support member. The support member is vertically displaceably received in a holding member and rests on fluid cushion, particularly an oil cushion. Preferably, the oil cushion is covered by a flexible membrane on which the support member rests. In order to avoid an overcompensation particularly in conjunction with short bending bars, the support member is separated into a plurality of supporting member elements along its longitudinal extension; thus, each supporting member element can be displaced independently of the other ones.

Advantageously, such a bending bar supporting design is used in conjunction with the method of the present invention to further improve the bending accuracy. A further advantage is that the step of releasing the bending force exerted on the workpiece to be bent can be executed by reducing the pressure in the oil cushion, thereby removing the need to drive the bending bar to a backward movement and accelerating the processing speed of a workpiece.

BRIEF DESCRIPTION OF THE DRAWINGS

In the following, the method of the invention will be further explained in detail with reference to the accompanying drawings.

DETAILED DESCRIPTION OF A PREFERRED EMBODIMENT

Figure 1:
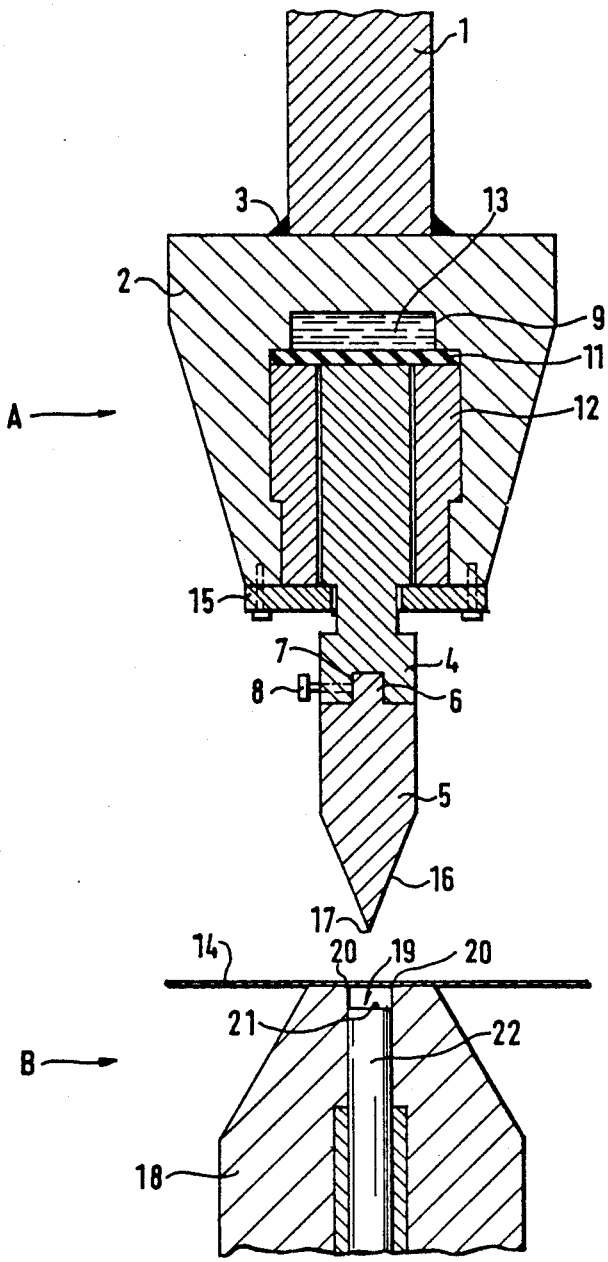
FIG. 1 shows a simplified cross sectional view of the essential parts of a bending apparatus used to perform the method of the invention.

According to FIG. 1, the bending apparatus used to perform the method of the invention basically comprises a vertically moveable upper tool assembly A and a fixed lower tool assembly B. The upper tool assembly A comprises a support member 1 which is fixed in any suitable manner to bending apparatus and driven to a reciprocating vertical movement. A holding member 2 is fixed to the support member 1 e.g. by means of a welding connection 3. The holding member 2 comprises a slot-like apparatus extending essentially along the entire width of the holding member 2. A bending bar holder 4 is slidably received in the aforementioned slot-like aperture. A bending bar 5 is mounted on the bending bar holder 4. The bending bar 5 is used to bend a workpiece, e.g. a piece of sheet metal 14. The bending bar 5 has a longitudinal upwardly projecting protrusion 6 received in a corresponding groove 7 of the bending bar holder 4 and is fixed therein by means of clamping screws 8.

The bottom of the aperture in the holding member 2 is provided with a channel 9 having a smaller width than the aperture and being covered by a flexible membrane 11. The membrane 11 is fixed by means of a fixing member 12 resting on a flange 15. The channel 9 is filled with a fluid 13, e.g. with oil. Means are provided (not shown in the drawing) to increase and decrease the fluid pressure of the oil 13 received in the channel 9. These means may include a pump; such a design is well known in the art and it must not be further explained.

The bending bar 5 comprises a bending edge 17 where the two lateral faces 16 of the bending bar join. It is essential that the angle enclosed between the two lateral faces 16 is smaller than the smallest bending angle to be realized by means of this bending bar 5.

It is possible to insert an intermediate member (not shown) between the bending bar holder 4 and the membrane 11 which acts as a support bean and which is separated in a plurality of individual beam elements along its longitudinal extension. Thus, only a certain portion of the beam is under load during the bending operation; the length of the aforementioned portion roughly corresponds to the length of the bending bar 5 used in an individual bending operation. An overcompensation of the deflection cannot occur even if the bending bar holder 4 is relatively short.

The lower tool B comprises a bottom die body 18 which is provided with a longitudinal groove 19 in its surface directed towards the bending bar 5. The bending angle is determined by the distance between the two upper edges 20 of the groove 19 and the depth of the groove, i.e. the position of the die bottom 21.

The shallow longitudinal groove 196 is arranged in the longitudinal central plane of the bottom die body 18 and equipped with a die bottom member 21 which is adjustable with regard to its height position. In a preferred embodiment, the die bottom member can be constituted by a plurality of pins 22 slidably arranged in aperture provided in the bottom of the bottom die body 18. The upper surfaces of the pins 22 constitute the die bottom 21.

In order to adjust the height position of the pins 22, the free ends of the pins 22, remote from the upper surfaces 21, may rest on an adjustment rail (not shown) which is displaceable along an inclined surface. In this way, a precise lifting or lowering of the die bottom 21 is possible. Such a design is known in the art and need not be further described.

As can be seen from FIG. 1, the piece of sheet material 14 to be bent rests on the top surface of the bottom die body 18 above the longitudinal groove 19. Before the bending operation is started, the die bottom 21 is adjusted such that it defines, together with the two upper edges 20 of the die body 18, an angle which is greater than the final nominal angle to which the sheet metal piece 14 has to be bent. By lowering the bending bar 5 towards the bottom die 18, the sheet metal piece 14 is pressed against th die bottom 21 by means of the bending edge 17. In this position, the sheet metal piece 14 is under a certain amount of bias due to the elastic behaviour of the sheet metal. This bias is released by removing the bending force exerted on the sheet metal piece 14; for this purpose, the bending bar 5 is retracted a small amount. According to a preferred embodiment of the method of the invention, it is also possible to effect the removal of the bending force and thereby the release of the bias by reducing the pressure in the oil cushion 13 contained in the longitudinal channel 9. Thereby, the sheet metal piece 14 resiliently moves back a small amount and keeps a stable intermediate position.

In a further step, the angle between the two legs of the sheet metal piece 14 is measured, when the sheet metal piece is in its slacked position, by means of a (not shown) angle measuring apparatus. The measured value of the actual bending angle is compared with the nominal angle which corresponds to the actual height position of the adjustable die bottom 21. Thereafter, the die bottom 21 is displaced to a position which corresponds to the final nominal bending angle to be realized and re-adjusted taking into account the previously calculated difference between nominal value and actual value. Finally, the workpiece 14 is pressed against the re-adjusted die bottom 21 taking its definitive height position by means of the fully loaded bending bar 5.

The aforementioned last step can be performed by increasing the pressure in the oil cushion 13 contained in the longitudinal channel 9. The correction of the bending angle is always performed in conjunction with a lowering of the die bottom 21 in order to diminish the bending angle because an enlargement of the angle is not possible as can be easily understood. This is the reason why a greater angle is chosen in the first step, i.e. an angle which is greater than the final nominal angle to which the sheet metal piece 14 is to be bent.

In the following, the method of the invention will be explained in more detail with reference to the diagrammatic views of FIGS. 2–7. It must be emphasized that the views are heavily exaggerated in order to more clearly show the conditions occuring during the bending operation.

Figure 2:
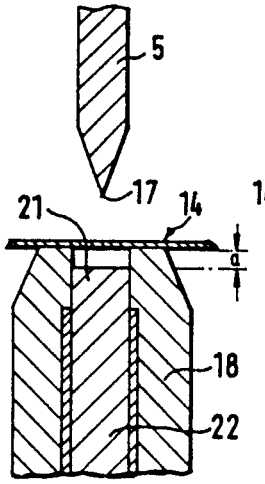
FIGS. 2–7 show diagrammatic cross sectional views of the bending bar, the bottom die and a sheet metal piece in different consecutive steps of the bending operation.

According to FIG. 2, in an initial situation, the bending bar 5 is retracted and a sheet metal piece 14 to be bent rests on the top surface of the bottom die 18 over the longitudinal groove. The adjustable die bottom 22 is in a first position in which the distance between the surface 21 of the die bottom 22 and the top surface of the bottom die 18 has the value a. This position a corresponds to a certain bending angle $\alpha$, the first nominal bending angle, which is somewhat greater than the predetermined nominal bending angle $\beta$ finally to be achieved.

Figure 3:
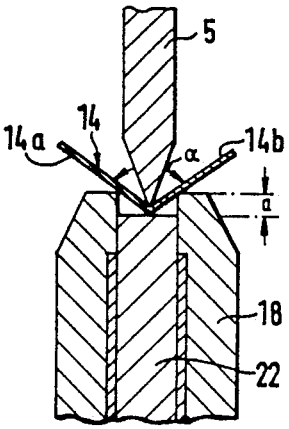
Figure 4:
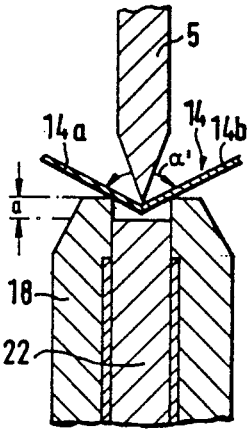

Now, the bending bar 5 is displaced towards the bottom die 18, abuts against the surfaces of the sheet metal piece 14 and begins to bend it. This forward movement of the bending bar 5 is continued until the leading edge of the bend in the sheet metal piece 14 contacts the surface 21 of the adjustable die bottom 22 and then interrupted. In this moment, the two legs 14a and 14b of the sheet metal piece enclose the calculated first nominal bending angle $\alpha$. This situation is shown in FIG. 3.

Thereafter, the bent sheet metal piece 14 is released; for this purpose, e.g. the bending bar 5 may be retracted a small amount. As can be seen from the view in FIG. 4, the bent sheet metal piece 14 resiliently moves back somewhat with the consequence that th angle $\alpha'$, the first actual bending angle, enclosed by the two legs 14a and 14b is somewhat greater than the theoretically calculated first bending angle $\alpha$. Such resilient back motion is observed with essentially all kinds of sheet metal and the rate of resilient back motion depends on the material and the quality of the sheet metal, the thickness thereof etc.

In the next step, the first and actual bending angle $\alpha'$ present on the sheet metal piece in its slacked condition is measured. This can be accomplished easily by means of the previously mentioned angle measuring apparatus. The value of the first nominal bending angle $\alpha$ is known; thus, the difference $(\alpha'-\alpha)$ between the first actual bending angle and the first nominal bending angle can be caluclated. In addition, the position b of the adjustable die bottom 21 is theoretically known in which a sheet metal piece will be bent exactly to a final predetermined bending angle $\beta$. Finally, the rate of resilient back motion $(\alpha'-\alpha)$ is known since it has been previously calculated. From these values the final height position $(b+\Delta b)$ of the die bottom 21 may be derived, i.e. that position in which the sheet metal piece will have the desired final predetermined bending angle in its slacked condition.

Figure 5:
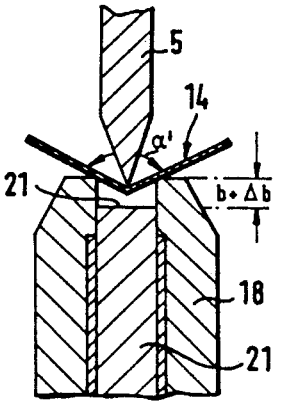
Figure 6:
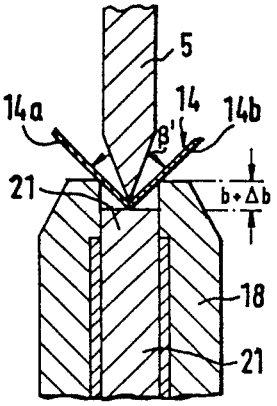
Figure 7:
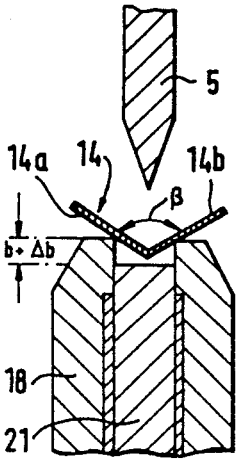

According to the FIG. 5, the adjustable die bottom 22 is then adjusted to a second position in which the distance between its surface 21 and the surface of the bottom die 18 amounts to the value of $(b+\Delta b)$. The value of $(b+\Delta b)$ is somewhat higher than the value of the distance a, resulting in more acute bending angle. Thereafter, the bending bar 5 is moved towards the bottom die 18 again until the leading edge of the bend in the sheet material piece 14 touches the surface 21 of the adjustable die bottom 22 and then the forward motion of the bending bar 5 is interrupted. This situation is shown in FIG. 6. Thereby, the two legs 14a and 14b of the bent sheet metal piece 14 enclose a second nominal bending angle $\beta'$ the value of which is somewhat less than the value of the finally desired predetermined bending angle $\beta$. The bending force having been removed from the sheet metal piece 14, e.g. by retracting the bending bar 5 a small amount (FIG. 7), the bent sheet metal piece 14 resiliently moves back and finally the two legs 14a and 14b thereof will enclose the desired predetermined bending angle $\beta$.

In practice the two angles $\alpha$ and $\beta$ differ only by a small amount; as an indication the following example might serve:

If a piece of sheet metal has to be bent to an angle of exactly 90°, the first bending operation is performed to a first nominal bending angle $\alpha$ of about 91°, i.e. to an angle which is certainly somewhat greater than the predetermined final bending angle $\beta$. The initially bent sheet metal piece having been unloaded, the two legs of the sheet metal piece resiliently move back somewhat such that they now enclose a first actual bending angle $\alpha'$ of 93°. Thus, the difference is 2°.

It can be assumed that the resilient back motion after the successive second bending operation will take place by the same angular amount as the conditions remain essentially unchanged. Consequently, the sheet metal piece having been unloaded, the die bottom is adjusted such that a second nominal bending angle $\beta$ amounting to 88° will result, measured on the loaded sheet metal piece. As soon as the bending force is released after the second bending operation, the two legs of the sheet metal piece resiliently move back each by 1° with the result that the final bending angle exactly corresponds to the desired predetermined bending angle of 90°.

All operations necessary to perform the method of the invention can be effected automatically and preferably under program control as the described apparatus elements required for the bending operation are well suited therefor.

What I claim is:

1. A method of bending a workpiece to a predetermined bending angle by means of a bending apparatus which comprises a movable bending bar resiliently supported on a pressurized fluid cushion and a fixed bottom die having a die bottom member, the height position thereof being adjustable in accordance with the bending angle to be achieved, the method comprising the successive steps of:

adjusting said die bottom member to a height position which corresponds to a first nominal bending angle greater than said predetermined bending angle;

inserting said workpiece to be bent between said moveable bending bar and said fixed bottom die and displacing said bending bar towards said bottom die until the leading edge of said workpiece abuts against the top of said die bottom member, thereby continuously bending said workpiece to said first nominal bending angle;

reducing the pressure in said fluid cushion on which said movable bending bar is supported, thereby allowing said workpiece to resiliently move back into its slacked condition;

measuring the actual bending angle of said workpiece when it is in its slacked position and comparing the value of said first actual bending angle with the value of said first nominal bending angle;

re-adjusting said die bottom member to a height position corresponding to a second nominal bending angle having the value of said predetermined bending angle minus said calculated difference between said measured first actual bending angle and said first nominal angle;

again exerting a bending force on said workpiece to be bent until the leading edge of said workpiece abuts against the top of said die bottom member thereby further bending said workpiece to said second nominal bending angle; and releasing the bending force exerted on said workpiece bent to second nominal bending angle, thereby allowing said workpiece to resiliently move back into its slacked condition in which it is bent to said predetermined bending angle.

2. A method of bending a workpiece to a predetermined bending angle by means of a bending apparatus which comprises a movable bending bar resiliently supported on a pressurized fluid cushion and a fixed bottom die having a die bottom member, the height position thereof being adjustable in accordance with the bending angle to be achieved, the method comprising the successive steps of:

adjusting said die bottom member to a height position which corresponds to a first nominal bending angle greater than said predetermined bending angle;

inserting said workpiece to be bent between said moveable bending bar and said fixed bottom die and displacing said bending bar towards said bottom die until the leading edge of said workpiece abuts against the top of said die bottom member, thereby continuously bending said workpiece to said first nominal bending angle;

reducing the pressure in said fluid cushion on which said movable bending bar is supported, thereby allowing said workpiece to resiliently move back into its slacked condition;

measuring the actual bending angle of said workpiece when it is in its slacked position and comparing the value of said first actual bending angle with the value of said first nominal bending angle;

re-adjusting said die bottom member to a height position corresponding to a second nominal bending angle having the value of said predetermined bending angle minus said calculated difference between said measured first actual bending angle and said first nominal angle;

increasing the pressure in said fluid cushion on which said movable bending bar is supported until the leading edge of said workpiece abuts against the top of said die bottom member thereby further bending said workpiece to said second nominal bending angle; and releasing the bending force exerted on said workpiece bent to said second nominal bending angle, thereby allowing said workpiece to resiliently move back into its slacked condition in which it is bent to said predetermined bending angle.

* * * * *